US005483705A

United States Patent [19]

DiMatteo

[11] Patent Number: 5,483,705

[45] Date of Patent: Jan. 16, 1996

[54] FEMALE ATHLETIC PROTECTIVE SYSTEM

[76] Inventor: Frank J. DiMatteo, 501 Sunnyfield Dr., Monroeville, Pa. 15146

[21] Appl. No.: 334,533

[22] Filed: Nov. 4, 1994

[51] Int. Cl.[6] ..... A41B 9/00; A41B 9/04

[52] U.S. Cl. ..... 2/406; 2/2; 2/2.5; 2/267; 2/400; 2/403; 450/146

[58] Field of Search ..... 2/1, 2, 2.5, 400, 2/401, 402, 403, 405, 406, 407, 409, 267; 450/146, 155; 128/891; 602/70, 71, 72, 67

[56] References Cited

U.S. PATENT DOCUMENTS

| | | | |
|---|---|---|---|
| 2,896,631 | 7/1959 | Block | 450/56 X |
| 3,176,686 | 4/1965 | Barnes | 2/2 X |
| 3,310,053 | 3/1967 | Greenwood | 2/2 |
| 3,787,892 | 1/1974 | Quinn | 2/2 |
| 3,788,314 | 1/1974 | Noreen | 2/2 |
| 3,909,847 | 10/1975 | Holt et al. | 2/2 |
| 3,931,816 | 1/1976 | Waldmann | 450/155 X |
| 4,014,044 | 3/1977 | Figueroa et al. | 2/2 |
| 4,811,427 | 3/1989 | Regan | 2/2 |
| 4,922,899 | 5/1990 | Graff et al. | 2/2 |
| 5,134,726 | 8/1992 | Ross | 2/267 X |
| 5,243,974 | 9/1993 | Allen | 2/403 X |
| 5,281,186 | 1/1994 | Buckley et al. | 2/267 |

*Primary Examiner*—Jeanette E. Chapman
*Attorney, Agent, or Firm*—James Ray & Associates

[57] ABSTRACT

A protective device for protecting a female genital region, particularly during athletic competition, having an elongated, banana-shaped cup portion with an elongated concave cavity having sufficient volume to bridge over the wearer's vagina and perineum without contact therewith, and adapted to extend rearwardly between the wearer's upper thighs with the edge of the cavity proximate to the superior ramii, the inferior ramii, and/or the Ischial ramii of the pelvis, with minimal contact with the upper thighs, and a resilient padding mounted onto the edge of said cavity adapted to absorb at least a major portion of any impact experienced by said cup, and optionally including a curved, kidney-shaped shield portion adapted to fit against a wearer's bowel area sufficient to overlay and shield the ovaries.

19 Claims, 5 Drawing Sheets

FEMALE ATHLETIC PROTECTIVE SYSTEM

FIELD OF THE INVENTION

This invention relates generally to protective devices, and more particularly to devices and a system for protecting the female genital area particularly during athletic competition. The invention includes a cup for the protection of the female genital region, as well as a front shield for protecting the lower abdomen area, and includes an undergarment supporter for containing and properly positioning the cup and shield.

BACKGROUND OF THE INVENTION

Cups and other devices for the protection of the male groin region are well known and extensively utilized, particularly for protection during athletic competition. Generally, these devices are limited to the "jockstrap" or athletic supporter, which is an elastic-fabric garment used to support the male genitals, and to the "cup", which is a rigid cup-like enclosure normally positioned within a pouch of a specially designed jockstrap type of athletic supporter, and is intended to physically shield the genitals from physical impact. Such cups normally define a cavity area which is designed to encase the male genitals, and a resilient rubber covered edge portion surrounding the cavity, intended to fit against the abdomen around the genitals, which transfers any impact forces on the cup to the abdomen. While the use of an athletic supporter or jockstrap alone may be adequate protection for some athletic activities, such as swimming, field and track events and other non-contact sports, it is most common to wear a cup during athletic activities such as football, hockey, rugby, soccer, and other such contact sports activities to protect the male genitals from injury as the result of inadvertent physical blows to the groin region.

It is well recognized that women as well as young girls are progressively getting more and more involved in athletic competition, which includes even contact athletics, not only as a result of all-female teams, leagues, etc., but females are even participating in what had previously been considered all-male athletics, such as a school's regular varsity football team and other contact athletics. In addition to team athletics, an increasing number of women and girls are taking-up the martial arts, if not for the enjoyment of the athletic competition, then at least for the purpose of learning the art of self protection.

While the female genital region is significantly different from that of a male, significant injury can nevertheless, result from an unintended physical blow to the female genital area. Yet, there are no protective cups or other devices commercially available for protecting female athletes. While a female athlete may choose to utilize and wear a male protective cup during athletic competition, the physical differences between male and female genitals and surrounding anatomy, will render the cup less than ideal in that it will not provide the optimum protection desired, will not normally stay properly positioned where desired, and will generally not be comfortable to a female wearer.

SUMMARY OF THE INVENTION

This invention is predicated upon a new and unique safety device and system, specifically designed to provide good protection for female genitals and prevent injury as a result of unintended blows to the genital region, particularly during athletic competition.

In essence, the protective device of this invention comprises two major portions, namely an oval-shaped abdomen shield portion adapted to fit against a wearer's bowel area sufficient to overlay and shield the ovaries; and an elongated, banana-shaped cup portion with a convex outer side and a concave inner side adapted to protect the female vagina and vaginal area. The cup portion, which can be physically attached to the abdomen shield portion or provided separately, has an elongated cavity on the concave inner side with sufficient volume to contain and bridge over the vagina and perineum, without contact therewith, and adapted to extend rearwardly between the wearer's upper thighs proximate to the superior ramii, the inferior ramii, and/or the Ischial ramii of the pelvis, with minimal contact with the upper thighs. A resilient padding is mounted onto the peripheral edge of the cavity to absorb at least a portion of any impact experienced by the cup.

With regard to the device supporter of this invention, a tight fitting undergarment, such a tights, is provided with at least one pocket adapted to receive the protective device and maintain it in proper position to provide the protection intended. The undergarment should be tight fitting at least from the waist to below the genital area. My patent application Ser. No. 08/308,602, filed Sep. 9, 1994, teaches a supporter for a male protective cup, having an elastic waist band and two sets of unique leg straps designed to greatly enhance the stability and maintain the proper position of the cup during excessive athletic activity and prevent the cup from being pushed from the supporter. While female athletes would not likely be comfortable wearing such a supporter as is designed for males, the unique waste band and leg strap arrangement as taught in that patent application could be physically incorporated into female tights or other such undergarment for the similar purpose of stabilizing the cup portion of the female protective device of this invention. Accordingly, the teachings in the above-cited co-pending patent application are incorporated herein be reference.

OBJECTS OF THE INVENTION

The primary object of this invention is to provide a protective device and system designed specifically to be worn by females for purposes of protecting the female genital region from injury, particularly during athletic activity.

Another object of this invention is to provide a protective device specifically to be worn by females for purposes of protecting both the female ovaries and the female vaginal area from injury during athletic activity.

A further object of this invention is to provide a protective device specifically to be worn by females for purposes of protecting the female ovaries from injury during athletic activity.

Still another object of this invention is to provide a protective cup specifically to be worn by females for purposes of protecting the female vagina and vaginal area from injury during athletic activity.

An even further object of this invention is to provide an undergarment supporter for maintaining the above-said protective device, including the shield and/or cup in their intended position.

These and other objects and advantages of this invention will become apparent from a better understanding of the following detailed description of the invention.

DESCRIPTION OF THE PREFERRED EMBODIMENTS OF THE INVENTION

Figure 1:
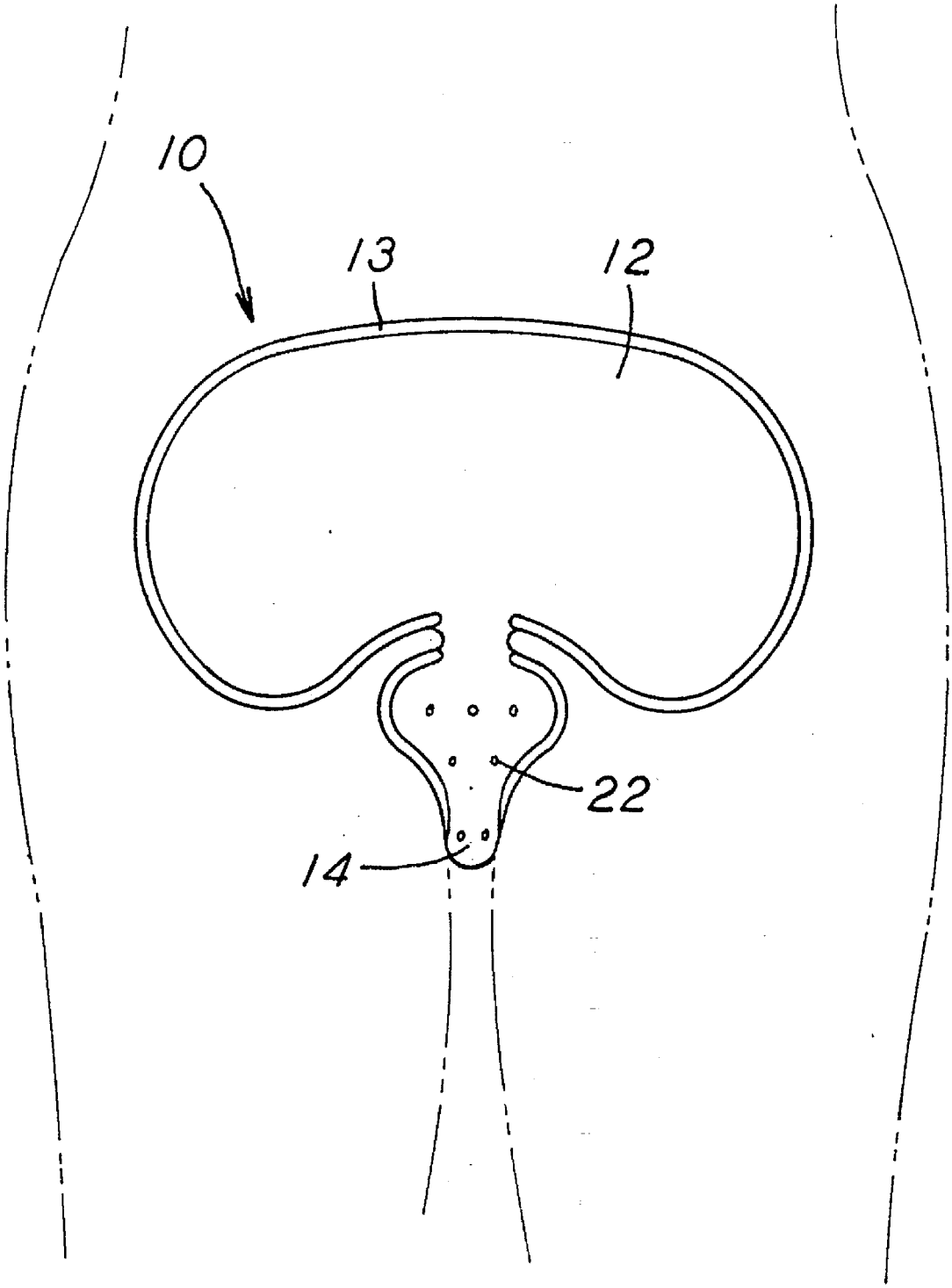
FIG. 1 is a front view of a protective device in accordance with a presently preferred embodiment of this invention showing its intended position when worn by a woman, and wherein the cup and abdomen shield are joined as a single piece unit.

Prior to proceeding with a detailed description of the subject invention, it is noted that for the sake of clarity, identical components which have identical functions have been identified with identical reference numerals throughout the several views of the attached drawings.

Figure 3:
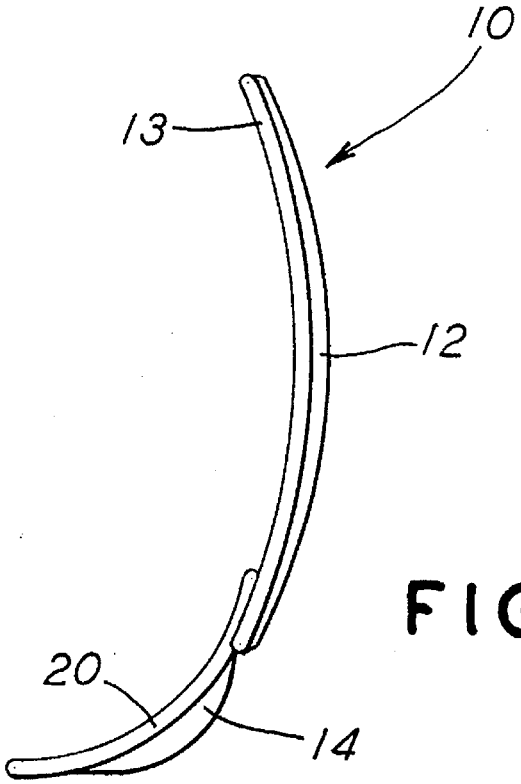
FIG. 3 is a side view of the protective device shown in FIGS. 1 and 2.
Figure 2:
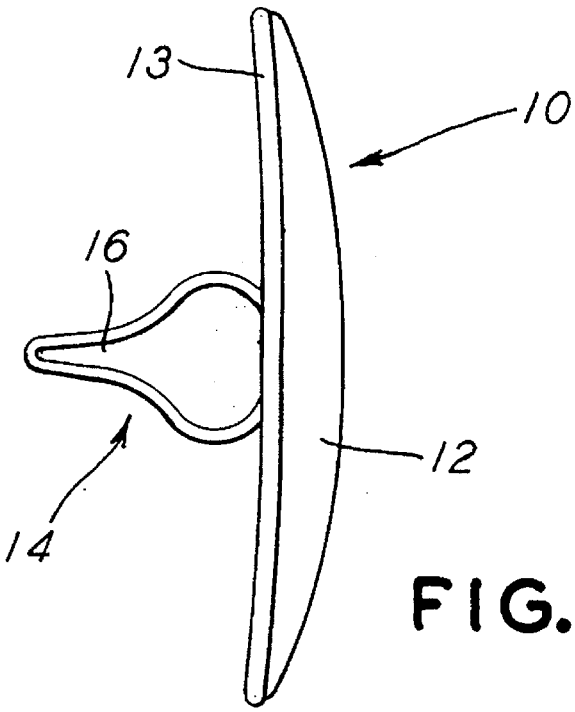
FIG. 2 is a top view of the protective device shown in FIG. 1.
Figure 7:
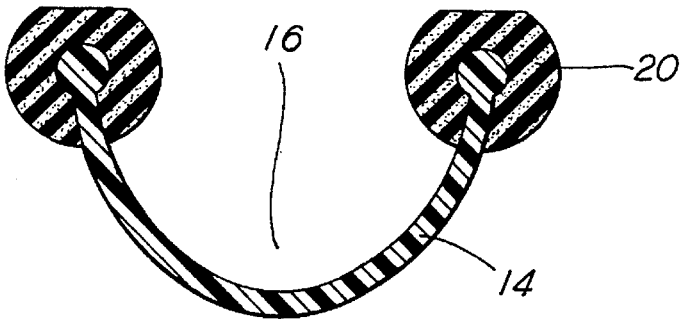
FIG. 7 is a cross-sectional view of the cup as shown in any of the preceding Figures, with the section taken at line VII—VII of FIG. 5.

Reference to FIGS. 1–3 will illustrate one presently preferred embodiment of the protective device of this invention, which comprises a generally rigid body, generally designated 10, having a slightly spooned, generally kidney-shaped, shield portion 12 adapted to fit against the contour of a female wearer's front bowel area sufficient to overlay and shield the ovaries; and an elongated, banana-shaped, or canoe-shaped, cup portion 14 with a convex outer side and a concave inner side to provide an elongated cavity 16 (FIG. 7) on the concave inner side the cup 14. The elongated cavity 16 should have a sufficient volume to contain and bridge over the wearer's vagina as well as the perineum without contacting either the vagina or the perineum. The cup portion 14 should be further adapted to extend rearwardly and laterally between the wearer's upper thighs with the peripheral edges of the cavity 16 proximate to the superior ramii, the inferior ramii, and/or the Ischial ramii of the pelvis, with minimal contact with the upper thighs. As in the case of most men's cups, a resilient padding 20 is mounted onto the peripheral edge of the cavity 16, as well as the peripheral edge of abdomen shield 12, adapted to absorb at least a major portion of any impact experienced by the cup 14 and shield 12. In addition, the inner face of abdomen shield 12 is preferably provided padding, either fabric or foam rubber or the like, also adapted to absorb a major portion of any impact experienced by the shield 12 to protect the bowel area and ovaries from injury.

While the shield portion 12 is described as generally kidney-shaped, it can be seen from FIG. 1 that its shape is not truly kidney-shaped, but should be the same on each side to provide the same degree of protection on each side. The actual shape is not in fact critical, as long as the shield 12 adequately overlays the ovaries, and has a well rounded periphery to prevent any corners that could be forced into the wearer's abdomen. Accordingly, an oval-shape or comparably rounded form should also be adequate. As used herein after, "generally oval-shaped" is meant to include kidney-shaped, oval shaped, or any other suitable closed and rounded shape intended to overlay the bowel area including both ovaries. Since the shield portion 12 is adapted to fit flat against the wearer's abdomen, there will be no edges thereof oriented towards the wearer in need of padding. For optimum comfort as well as protection, however, shield portion 12 is preferably provided with a flat sheet of padding material 13 against the concave inner surface. Preferably, this sheet of padding 13 can be rolled around the peripheral edge of shield portion 12 as shown in FIG. 1, to assure that the wearer is protected from impact with the edge of shield portion 12.

Figure 4:
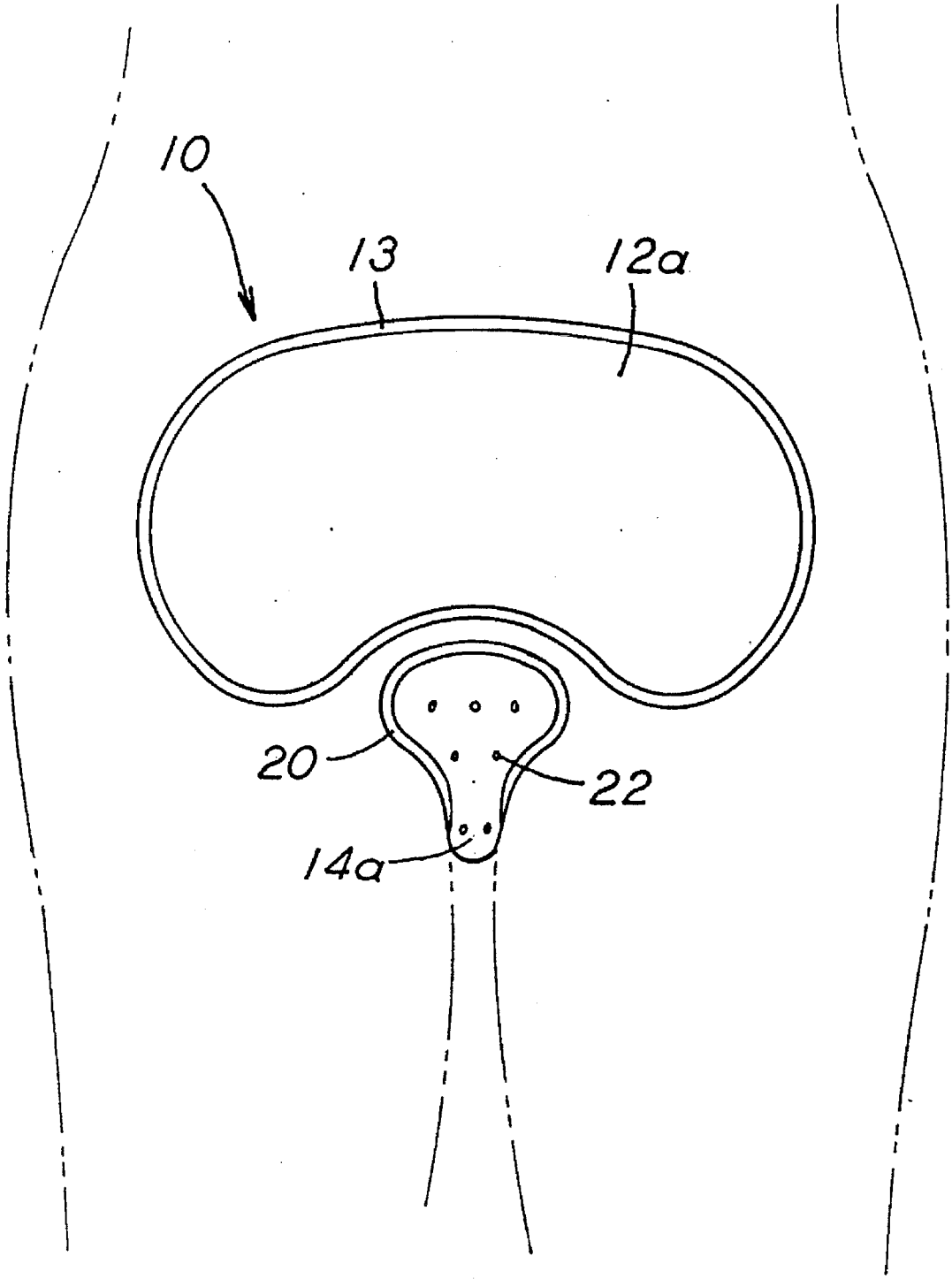
FIG. 4 is substantially the same as FIG. 1 but showing the cup and abdomen shield as separate elements.
Figure 5:
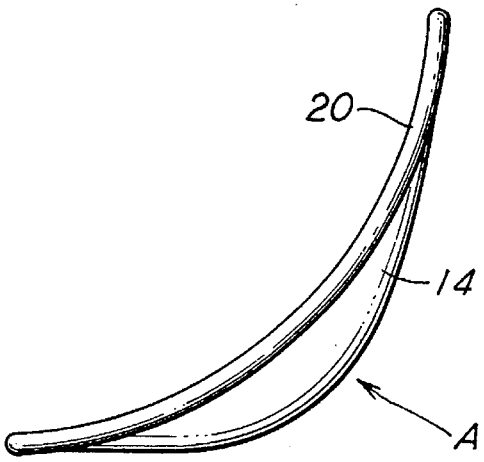
FIG. 5 is a side view of the cup portion of the protective device shown in FIG. 4.
Figure 6:
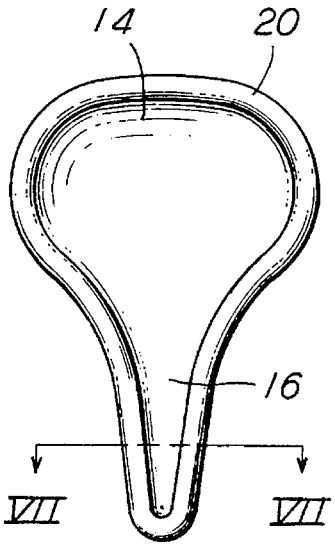
FIG. 6 is an plan view of the cup shown in FIGS. 4 and 5 as seen from the "A" direction as shown in FIG. 5.

While the general oval-shaped shield portion 12, and the elongated, banana-shaped cup portion 14 can be formed as a one piece device as shown in FIGS. 1–3, these two portions can be provided as separated elements, so that a female athlete can choose to wear either one portion separately, or wear both as separated elements, as well as the one-piece unit as shown in FIGS. 1–3. Particularly when it comes to differences of stature or height, some wearers may find that the two portions of the one-piece unit may not be properly aligned when worn, and may therefore, find that wearing the two portions as separate units may be more comfortable and will better position the two respective portions. FIG. 4 illustrates the individual abdomen shield **12*a* and FIGS. 4–6 illustrate the individual cup 14*a* as individual, unjoined units in accordance with another preferred embodiment of this invention, as discussed above. When produced as a single unit as illustrated in FIG. 1, however, some degree of flexibility between the generally oval-shaped shield portion 12, and the elongated, banana-shaped cup portion 14 is preferred in order to maximize the wearer's freedom to bend freely at the waist. If the material of fabrication tends to be rather stiff, such freedom of bending will be accommodated by minimizing the area of contact between the two components as shown in FIG. 1**.

A plurality of apertures 22 are preferably provided through cup 14 and/or **14*a* to afford ventilation to the vaginal area. Although the apertures 22 are not necessary for protection, the ventilation will render the cup portion 14 and/or cup 14*a*** more comfortable during prolonged wear, at least, in minimizing perspiration and the accumulation of moisture.

The top end of the cup **14*a*, if disjoined from the kidney-shaped shield portion 12, is preferably rounded or curved, as shown in FIG. 4, to arcuately contact the wearer's abdomen above the pubic area without having any corners or intersections between the side edges at the top of the cup 14*a*, and may be curved away from the abdomen to prevent the possibility for the cup 14*a* to be driven into the wearer's abdomen above the pubic area. Therefore, if the cup 14*a*** is forcefully impacted sufficient to force it upward, there are no corners or pointed or angled portions at the top thereof to be forced into the wearer's abdomen, and cause pain or injury.

The protective device 10, or the individual components if manufactured separately, are preferably formed of a substantially rigid plastic material of construction such as polypropylene, high density polyethylene or similar material sufficiently rigid so that the device 10 will retain its shape when impacted. Although virtually any substantially rigid plastic material may be used in the construction of device 10 or the individual components, care must be taken to insure that the plastic material is sufficiently strong and tough to minimize the possibility of fracture or deformation when impacted and sufficiently inert to possess no irritating characteristics that can cause skin irritation or rashes. While in one embodiment of the invention, it is contemplated that device 10 and individual components will be extruded from Hercules GR1 extrusion grade polypropylene, it should be apparent that the device 10 may be extruded, vacuum formed, molded or otherwise formed by any suitable process, utilizing any suitable rigid material, including metal. While rigid or substantially rigid materials are preferred for purposes of assuring adequate protection in the more threatening situations, it should be appreciated that less than rigid material, such as a shaped stiff fabric material, can be utilized for situations where there is little or no probability of any particularly forceful blows to the genital region. Accordingly, it is not intended that the device of this invention be limited to fabrication from any given type of material.

A sheet of soft resilient face padding (not shown), is preferably provided adjacent to the concave inside surface of cavity 16 to space the female vagina from direct contact with such inner surface of the cavity 16. Depending upon the porosity of the material utilized for the resilient face padding, a plurality of apertures may or may not be necessary to facilitate ventilation to the vaginal area. While the apertures in face padding need not be aligned with the apertures 22 in cup 14 or 14*a*, such alignment could be beneficial if the face padding is directly bonded to the inner surface of cavity 16.

Figure 8:
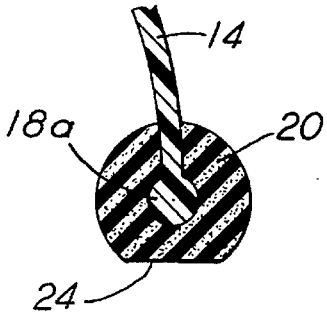
FIGS. 8, 9 and 10 are enlarged sectional views of the resilient padding mounted on the edge of the cup cavity showing three preferred embodiments of the preferred flattened side surface of the edge padding and three embodiments of the blunted cup edge.
Figure 9:
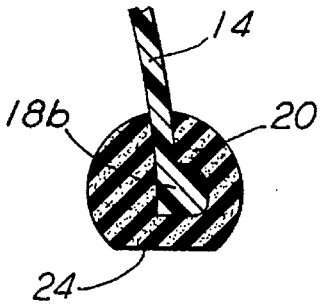
Figure 10:
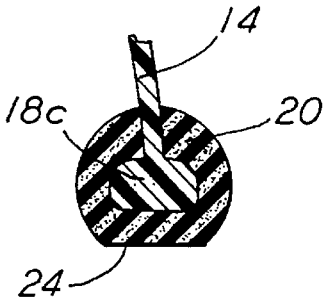

As on conventional men's protective cups, a resilient edge padding 20 is mounted around the edge of cavity 16 and is adapted to contact the wearer's lower body and absorb a major portion of the impact experienced by the cup 14 or 14*a*. The resilient edge padding 20 is preferably formed of natural rubber, or flexible polyurethane foam. In one embodiment of the invention, the resilient padding 20 is Craton Polyfoam flexible foam. Although the resilient edge padding 20 will protect the wearer somewhat from having the edge of the cup 14 or 14*a* driven against her lower body, is should be appreciated that the edge padding 20 is resilient and will be compressed around the narrow edge of the cup 14 or 14*a* when driven against the wearer's body with appreciable force. When so compressed, the narrow edge of the cup 14 or 14*a* can nevertheless cause some pain and damage particularly as a result of particularly forceful blows or repeated blows to the cup 14 or 14*a*. Therefore, a preferred embodiment of this invention is one where the edge of the cup 14 or 14*a* is blunted by incorporating a rounded bead 18*a*, a small right-angle flange 18*b* or a small "T" flange 18*c*, as shown in FIGS. 8, 9 and 10, adapted to present a widened flat or rounded edge towards the wearer's body, to enhance the surface area of the cup edge adjacent to the wearer's body. In this way, even particularly forceful blows to the cup 14 or 14*a*, which will compress the edge padding 20 between the wearer and the cup edge, will not expose the wearer's body to the normally narrow edge of the cup 14 or 14*a*. By avoiding narrow, conventional edges around cavity 16, it can be seen that there will be less tendency for the edge of the cup 14 and 14*a* to cut through the edge padding 20 and thereby loosen it from the cup 14 or 14*a*.

In a like manner, it is also preferred that the resilient edge padding 20 itself have a continuous, flattened surface 24 positioned such that the flattened surface 24 will mate with the contacting surface of the wearer's body. This will not only serve to reduce any pain or discomfort to the wearer in the event of a forceful blow to the cup 14 or 14*a*, but will serve to enhance the bonding force of the resilient material against the blunted cup edge as described above.

The resilient edge padding 20 may be generally tubular or cylindrical in form having a slit herein for mounting on the edge of cup 14 or 14*a* with an adhesive, or in the alternative is cylindrical in form and cast or molded directly onto the cup edge. In either event, such edge padding 20 can become loosened from the cup edge to the extent that the cup 14 or 14*a* becomes useless for its intended purpose. The inclusion of a blunted edge on the cup 14 or 14*a* as disclosed above, particularly in combination with a flattened surface on the edge padding 20, as described above, will also serve to improve any bonding between the edge padding 20 and the cup edge.

As disclosed in the above-mentioned patent application regarding the male protective cup, the cups 14 or 14*a* of this invention are preferably provided with a grid of reinforcing, protruding ribs (not shown) extending from the smooth outer surface of cup 14 or 14*a*. While the grid of ribs can be arranged in any desired pattern, such as a rectangular pattern, a preferable arrangement is a contoured parabolic arrangement, as shown in the reference patent application, which concentrates the ribs at the maximum protruding apex of the surface of the cup for maximum reinforcing affect. While placement of such ribs on the concave inside surface of the cup would provide some additional benefit as compared to the outside surface alone, such ribs positioned on the inside surface could be a source of irritation to the wearer, and are therefore, not preferred. For purposes of simplifying the drawings, a reinforcing grid is not illustrated with any of the attached drawings.

Figure 11:
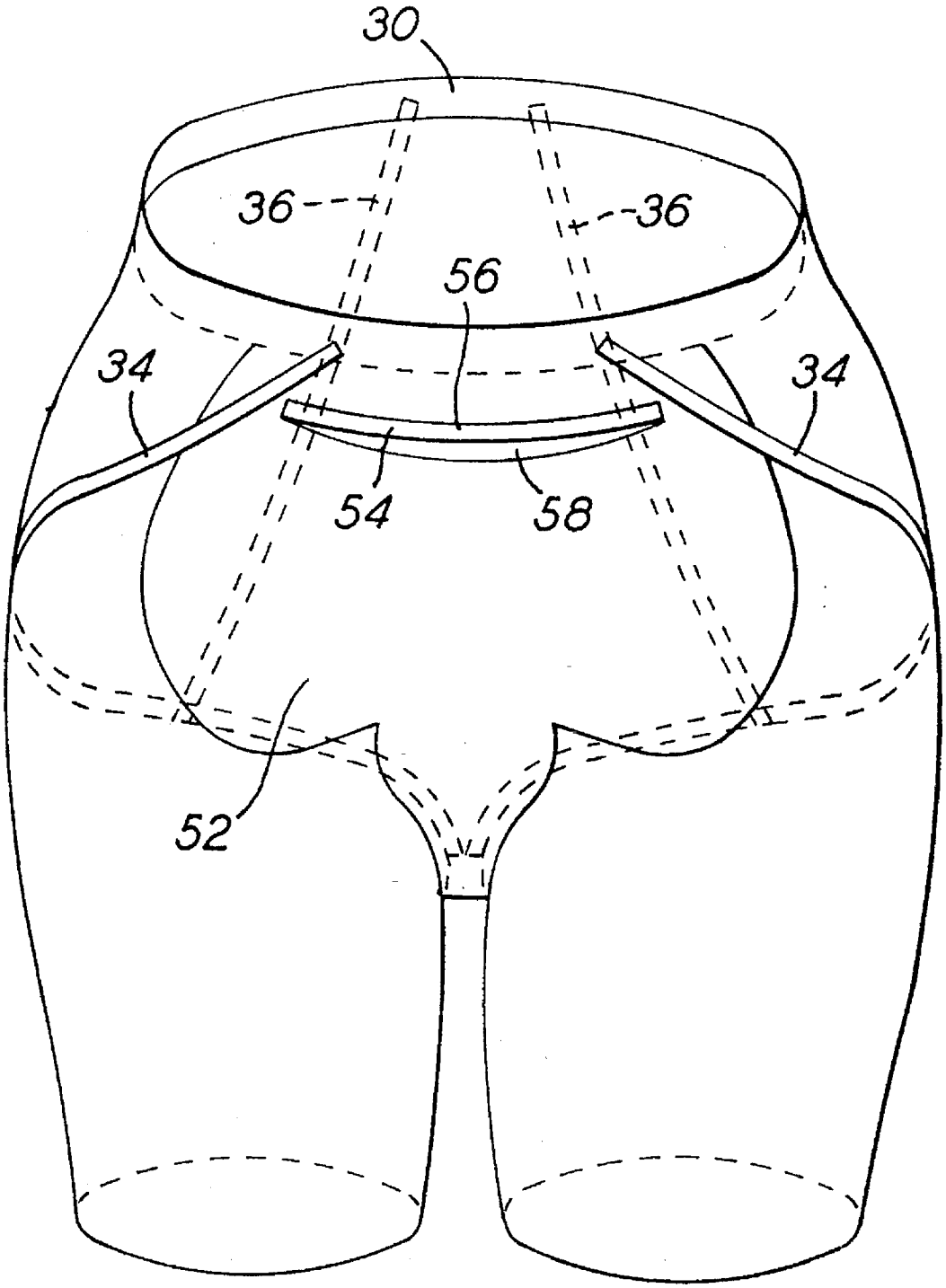
FIG. 11 is an isometric view of a presently preferred embodiment of a supporter undergarment in accordance with another aspect of this invention.

Although the protective device 10, or cup 14*a* and shield 12*a*, may be mounted to the body by straps or held in place by any desired under garment, a superior protective system can be achieved by utilizing the above disclosed device 10, or cup 14*a* and shield 12*a*, in combination with a supporter undergarment having one or more pouches incorporated therein specifically adapted to receive and properly position the protective means. Specifically, one presently preferred embodiment of the supporter according to this invention, as illustrated in FIG. 11, essentially comprises a tight fitting garment similar to tights as normally worn by female athlete under sport uniforms or other clothing, which is adapted to retain protective device 10, or cup 14*a* and shield 12*a*, in one or more pouch portions adapted to receive the protective unit 10, or in the alternative the separated shield 12*a* and cup 14*a*. As disclosed in the previously mentioned co-pending application for a male protective system, the pouch portions must have a means of access through which the protective device, or elements thereof, can be inserted and removed, preferably one which tends to lock the protective component or components into their proper location to assure that the protective component or components are not pushed from the pouch by the athletic activity where they cannot provide the protection intended.

More specifically, and with reference to FIG. 11, any such pouch, such as pouch 52 is normally formed by two layers of elastic fabric, having an outer layer and an inner layer, and should have an opening 54 through either one of the two layers through which the protective device 10 can be inserted, or in the alternative through which the individual shield 12*a* and cup 14*a* can be inserted. While prior art practice with regard to men's supporters has been to leave an opening at the top of the pouch between the two layers through which the protective cup can be inserted, the cup supporter undergarment of this invention is preferably provided with an opening 54 in either one of the two pouch layers displaced from the edges of pouch 52, for the purpose of leaving a portion of the pouch interior, and the edge of the inserted protective device 10, 12*a* and/or 14*a* cup, displaced from the opening 54. In this way, all the edges of the protective device 10, 12*a* and/or 14*a* will be positioned within the pouch 52 and displaced from opening 54, so that normal athletic activity will not cause the protective device to be forced through the opening 54 and dislodged from the pouch 52. Accordingly, any upwardly directed blows or forces against the cup 14 or 14*a* cannot drive the protective device 10 or cup 14*a* from the pouch 54 in which they are maintained. As an extra precaution in this regard, it is preferred that the opening 54 be an elongated slot-type opening having a width somewhat smaller than the width of the protective device intended to be contained therein, so that opening 54 will have to be stretched in order to fit the protective device 10, 12*a* and/or 14*a* into and out of the pouch, and also that the opening 54 be defined by a pair of flat elastic bands 58, one overlaying the other, thereby making it more unlikely that the protective device will be pushed from the pouch unintentionally. As an alternative, the slot-type opening 54 can be provided with a zipper (not shown) which will serve to lock the protective device into the pouch 52. In order to keep the cup portion 14 of protective device 10, or cup 14*a*, properly positioned with regard to the supporter undergarment, the pouch 52 should have a configuration as necessary to closely match the configuration of the cup portion 14, or cup 14*a*, to thereby prevent the cup portion 14, or cup 14*a*, from moving around within the pouch 52.

As an added preferred feature, the supporter undergarment should preferably incorporate stabilizing elastic straps, substantially as disclosed in the previously mentioned co-pending patent application for the men's supporter. Specifically, and with further reference to FIG. 11, the supporter garment should preferably include a relatively wide elastic waist band 30, having a generally elastic-fabric pouch 52 incorporated at the center-front below the waist band 30, adapted to extend downwardly over the female ovaries and genitals. One end each of a pair of elastic leg straps 34 should be incorporated into the garment; i.e., sewn in flush with the elastic fabric of the garment, with one end of each leg strap 34 attached to the lower end of pouch 32 with the opposite end of each leg strap 34 attached to the front of waist band 30 on either side of the center. The elastic leg straps 34 are accordingly intended to extend tightly from the bottom of pouch 32, positioned between the wearer's upper thighs, and extend upwardly and outwardly across the top extremity of each thigh, and accordingly over the hips to reengage the waist band 30 at the front. An elastic support strap 36 for each elastic leg strap 34, is also incorporated into the garment, one end of which is attached to approximately the mid-length of the associated leg strap 34, and extend diagonally upwardly across each side of the buttocks and attached to the waist band 30, generally opposed to the point where each leg strap 34 is attached at the front. Accordingly, while the elastic fabric of the garment itself will serve in part to maintain the protective device 10, or in the alternative the cup 14*a* and shield 12*a*, in their proper location, the arrangement of straps incorporated into the garment fabric, as described above, will serve to enhance both vertical and lateral support for the cup portion 14 of protective device 10, or for cup 14*a*, greatly preventing the possibility that any blow will displace the device 10, or cup 14*a*, from its intended position.

Having shown and described several embodiments of the invention above, it should be readily apparent that a great number variations could be made without departing from the spirit of the invention. While no dimensions or sizing has been described above, it should be appreciated that the protective device or cup and cup supporters can be made available in differing sizes not only to accommodate both adult, youth and child sizes, but to accommodate varying sizes in each group.

I claim:

1. A protective device for protecting a female genital region, particularly during athletic competition, comprising: a generally rigid body having a slightly spooned, generally oval-shaped shield portion adapted to fit against a wearer's bowel area sufficient to overlay and shield the ovaries; and an elongated, banana-shaped cup portion with a convex outer side and a concave inner side, extending from said shield portion and adapted to extend between such wearer's thighs; said banana-shaped cup portion having an elongated cavity on said concave inner side defined by a peripheral edge to said cavity, and having sufficient volume to bridge over the wearer's vagina and perineum without contacting the vagina or the perineum, and adapted to extend rearwardly between the wearer's upper thighs with said peripheral edge proximate to the superior ramii, the inferior ramii, and/or the Ischial ramii of the pelvis, with minimal contact with the upper thighs; and a resilient padding mounted onto said peripheral edge of said cavity adapted to absorb at least a major portion of any impact experienced by said cup.

2. A protective device for protecting a female genital region according to claim 1 in which said peripheral edge of said cup is blunted sufficient to eliminate placement of a narrow cup edge perpendicularly towards the wearer's body.

3. A protective device for protecting a female genital region according to claim 2 in which said blunted peripheral edge comprises a cylindrical bead.

4. A protective device for protecting a female genital region according to claim 2 in which said blunted peripheral edge comprises a flange.

5. A protective device for protecting a female genital region according to claim 1 in which said resilient padding mounted on said peripheral edge of said cup is provided with a continuous flattened side surface such that said continuous flattened surface is adapted to be in contact against the wearer's body.

6. A protective device for protecting a female genital region according to claim 1 in which said shield portion and said cup portion are provided as a separate elements.

7. A protective cup for protecting a female vaginal region, particularly during athletic competition, comprising: an elongated, banana-shaped cup with a convex outer side and a concave inner side; said banana-shaped cup having an elongated cavity on said concave inner side defined by a peripheral edge to said cavity, and having sufficient volume to bridge over the wearer's vagina and perineum without contacting the vagina and perineum, and adapted to extend rearwardly between the wearer's upper thighs with said peripheral edge proximate to the superior ramii, the inferior ramii, and/or the Ischial ramii of the pelvis, with minimal contact with the upper thighs; and a resilient padding mounted onto said peripheral edge of said cavity adapted to absorb at least a major portion of any impact experienced by said cup.

8. A protective cup for protecting a female vaginal region according to claim 7 in which said peripheral edge of said cup portion is blunted sufficient to eliminate placement of a narrow cup edge perpendicularly towards the wearer's body.

9. A protective cup for protecting a female vaginal region according to claim 7 in which said blunted outer edge comprises a cylindrical bead.

10. A protective cup for protecting a female vaginal region according to claim 7 in which said blunted outer edge comprises a flange.

11. A protective cup for protecting a female vaginal region according to claim 7 in which said resilient padding mounted on said peripheral edge of said cup is provided with a continuous flattened side surface such that said continuous flattened surface is adapted to be in contact against the wearer's body.

12. A protective cup for protecting a female genital region according to claim 7 in which said cup has a generally curved upper edge adapted to arcuately contact the wearer's abdomen above the pubic area without having any corner intersections between the side edges of said cup.

13. A protective shield for protecting female ovaries, particularly during athletic competition, comprising: a slightly spooned, generally oval-shaped shield member adapted to fit against the contour of a female wearer's front bowel area sufficient to overlay and shield the ovaries.

14. A protective shield for protecting female ovaries, according to claim 13, in which said shield has an inner surface provided with a resilient padding material, and a peripheral edge provided with a resilient edge padding.

15. A device supporter for holding a device for protecting a female genital region from injury particularly during athletic competition, comprising: a tight fitting garment adapted to fit from the waist to below the genital region, said tight fitting garment having at least one pouch therein adapted to contain a protective device and maintain such protective device in a proper position during wear, at least a portion of a said pouch is adapted to hold at least a portion of a protective device adapted to protect such female wearer's vaginal region, and said at least a portion of said pouch is adapted to extend between such wearer's thighs, said tight fitting garment further including an elastic waist band having front and back portions and adapted to fit snugly around such wearer's waist; a pair of elastic leg straps, one end of each said leg straps attached to a lower end of said pouch from a point between such wearer's thighs, with the opposite end of each said elastic leg straps attached to the front of said waist band adjacent to said pouch, said elastic leg straps adapted to extend from the bottom of said pouch between the wearer's upper thighs, and extend upwardly and outwardly across the top extremity of each thigh, over the hips and to said front portion of said waist band; and a pair of elastic support straps, one end of each said support straps attached to the approximate mid-length of one each of said elastic leg straps and the other end of each said support strap attached to said back portion of said waist strap, each of said support straps adapted to extend diagonally upwardly across one side of the buttocks.

16. A device supporter for holding a device for protecting a female genital region from injury, according to claim 15, in which said pouch has an opening comprising an elongated slit having a width smaller than the width of such protective device, and said opening positioned sufficiently displaced from an edge of such protective device that such protective device cannot be forced through said opening as a result of normal athletic activity.

17. A device supporter for holding a device for protecting a female genital region from injury, according to claim 16, in which said elongated slit opening comprises a pair of overlaying elastic strips with said opening being parallel to said pouch between said overlaying elastic strips.

18. A system for protecting a female genital region from injury comprising:

a supporter having an elastic waist band having front and back portions and adapted to fit snugly around a wearer's waist; a fabric pouch attached to said front portion of said waist band and adapted to extend downwardly over such wearer's female genitals, said pouch containing a rigid protective device and having an opening through which said rigid protective device can be inserted and withdrawn; a pair of elastic leg straps, one end of each said leg straps attached to a lower end of said pouch with the opposite end of each said elastic leg strap attached to the front of said waist band adjacent to said pouch, said elastic leg straps adopted to extend from the bottom of said pouch between the wearer's upper thighs, and extend upwardly and outwardly across the top extremity of each thigh, over the hips and to said front portion of said waist band; and a pair of elastic support straps, one end of each said support straps attached to the approximate mid-length of one each of said elastic leg straps and the other end of each said support straps attached to said back portion of said waist strap, each of said support straps adapted to extend diagonally upwardly across one side of the buttocks; and said rigid protective device within said pouch including a cup having a generally convex outer surface, a generally concave inner surface, an edge encircling at least said concave inner surface, and having sufficient volume to enclose a wearer's vagina and bridge over the wearer's perineum, said device having a rearwardly extending cup portion adapted to extend between such wearer's upper thighs and engage the body proximate to the superior ramii, the inferior ramii, and the Ischial ramii of the pelvis with minimal contact with the upper thighs; a resilient edge padding mounted on said edge of said cup adequate to contact such wearer's body at the lower portion thereof and absorb at least a major portion of any impact experienced by said cup.

19. A system for protecting a female genital region from injury according to claim 18, in which said device includes an kidney-shaped shield portion adapted to fit against a wearer's bowel area sufficient to overlay and shield the ovaries.

* * * * *